US006106411A

United States Patent [19]

Edwards

[11] Patent Number: 6,106,411

[45] Date of Patent: Aug. 22, 2000

[54] GOLF CLUB DESIGN AND CONSTRUCTION

[76] Inventor: Upton B. Edwards, 5125 N. 58th Ave., Glendale, Ariz. 85301

[21] Appl. No.: 09/412,342

[22] Filed: Oct. 5, 1999

[51] Int. Cl.[7] ..... A63B 53/00

[52] U.S. Cl. ..... 473/292; 473/409

[58] Field of Search ..... 473/291, 292, 473/409

[56] References Cited

U.S. PATENT DOCUMENTS

| | | |
|---|---|---|
| 3,963,236 | 6/1976 | Mann . |
| 4,058,312 | 11/1977 | Stuff . |
| 4,128,242 | 12/1978 | Elkins . |
| 4,165,874 | 8/1979 | Lexzatte et al. . |
| 4,189,144 | 2/1980 | Guzzle et al. . |
| 4,203,598 | 5/1980 | Stuff et al. . |
| 4,240,631 | 12/1980 | MacDougall . |
| 4,261,566 | 4/1981 | MacDougall . |
| 4,280,700 | 7/1981 | Plagenhoef . |
| 4,415,156 | 11/1983 | Jorgensen . |
| 4,674,324 | 6/1987 | Benoit . |
| 4,887,815 | 12/1989 | Hughes . |
| 5,094,101 | 3/1992 | Chastonay . |
| 5,318,296 | 6/1994 | Adams et al. . |
| 5,417,108 | 5/1995 | Chastonay . |
| 5,467,984 | 11/1995 | Veux et al. . |
| 5,478,073 | 12/1995 | Hackman . |
| 5,569,097 | 10/1996 | Veux et al. . |
| 5,608,160 | 3/1997 | Chastonay . |
| 5,792,946 | 8/1998 | Chastonay . |

*Primary Examiner*—Jeanette Chapman
*Assistant Examiner*—Stephen L. Blau
*Attorney, Agent, or Firm*—Aquilino, Welsh & Flaxman

[57] ABSTRACT

The present invention relates to still another improvement in golf club design. In accordance with the present invention, the laws of statics and dynamics are applied to create a precisely and efficiently balanced gold club head. The golf club of the present invention is constructed so that the moment generated at the center of mass of the entire club is essentially equal to the moment at the club head. This is accomplished by analyzing and adjusting the mass distribution within the golf club to move the relative positioning of the moment of the center of mass closer to the moment of the center of percussion on the club head. The invention thereby relates to the design and manufacture of a golf club, and a golf club set, which provides more positive power and control in the club head by applying superior physical characteristics in the construction of the golf club within the standards established by traditional golf club guide lines and the rules of golf.

9 Claims, 2 Drawing Sheets

FIG. 1
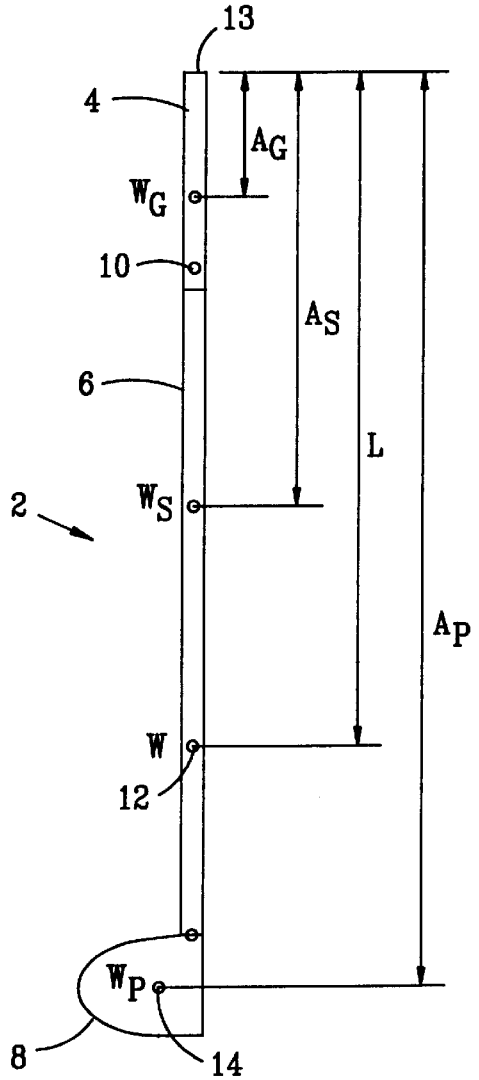
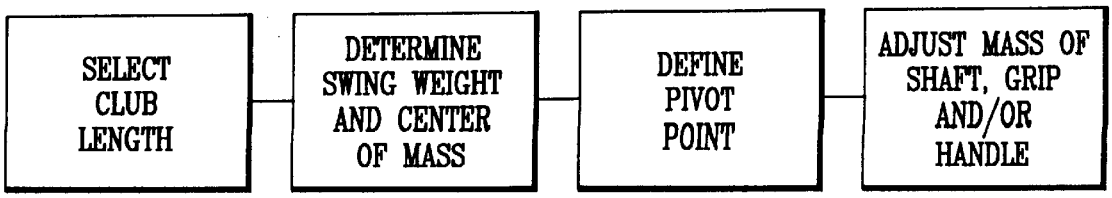
FIG. 3

GOLF CLUB DESIGN AND CONSTRUCTION

BACKGROUND OF THE INVENTION

1. Field of the Invention

The present invention relates to golf club design. More particularly, the present invention relates to a method for designing a golf club by applying pendulum technology engineering physics and the laws of physics to create an optimally fabricated golf club.

2. Description of the Prior Art

Golf clubs have historically been made by attaching a wood or iron type head to the end of an elongated flexible shaft having a grip on the opposite end thereof. The head is provided with a flat ball striking face whereby a golf ball may be propelled in a forward direction toward a target when the club strikes the ball. Little regard was previously given to the physical structure of the club other than the flexibility of the shaft, the overall weight, and the swing weight of the club head. In fact, many early golf clubs, used by successful tournament players, were selected solely based on the feel of the club in the players' hands. This was done totally without regard for the technical and physical characteristics of the golf club.

As modern technology has advanced, attention has been directed to the development of more technically precise golf clubs which are matched to an individual golfer's swing. Specifically, methods have been developed to account for the mass of the head, shaft, and grip, and their relationship in the design of golf clubs. These methods enable proper balancing for each of the individual clubs and allow a golfer to develop a single swing.

Algebraic and differential equations have been previously used to match components of a golf club for dynamic balancing the clubs in a set. Specifically, and in accordance with such procedures, different lengths and weights of the individual components of a golf club are analyzed with respect to the moment of inertia about a pivot point. However, the distribution of masses within golf clubs designed in accordance with these prior balancing procedures only provides a golfer with a similar feel among the golf clubs in a set of golf clubs, and does not generate a more efficiently weighted golf club.

By analyzing a golfer's swing, attempts have been made to adjust the weights and moments within a golf club to provide the golfer with a club ideally suited for his or her specific swing. A major drawback to this golf club design technique is its focus on a specific golfer. That is, only custom clubs can be manufactured in accordance with these methods. Golf clubs made in mass production cannot benefit from these methods.

The present invention overcomes these problems by adjusting the mass within a golf club to provide the golfer the opportunity for a longer and more accurate shot. Also, the present invention may be implemented for one specific club or for the manufacture of a complete set of clubs.

SUMMARY OF THE INVENTION

The present invention is directed to an improvement in the design of golf clubs. In accordance with the present invention, the laws of statics and dynamics are applied to create a precisely and efficiently balanced golf club. Golf clubs manufactured in accordance with the present invention are constructed such that the moment generated at the center of mass of the entire club is essentially equal to the moment at the club head's center of percussion. This is accomplished by analyzing and adjusting the mass distribution within the golf club to move the relative moment of the center of mass close to the moment of the club head's center of percussion. The analysis is performed under the assumption that a golf club acts as a pendulum with the pendulum's pivot point located at a position along the grip of a golf club where a golfer's grip would commonly end.

As such, the invention relates to the design and manufacture of a golf club, and a golf club set, providing more positive power and control in the club head by applying superior physical characteristics to the construction of the golf club within the standards established by traditional golf club guidelines and the rules of golf.

The first step in accordance with the present design technique is to select a club length. The club length is necessary to determine which type of golf club wood or iron is to be designed. The second step is to select a swing weight and determine the center of mass for the golf club. Next, the pivot point of the golf club is defined. Finally, the mass of the shaft, grip and club head are adjusted to bring the ratio $l_{h2}m_h/l_cm_c$ as close to one (1) as possible. More specifically, by setting the moments of the center of mass and the center of percussion equal around the pivot point 10, the mass of the shaft, grip and head of the golf club are adjusted to move the center of mass 12 such that the moment at the center of mass is made substantially equal to the moment at the center of percussion 14.

In order to achieve the highest degree of effectiveness, and in accordance with the present invention, the golf club is constructed such that the moment at its center of mass is substantially equal to the moment at the club head's center of percussion. When this occurs, and according to pendulum technology, the club acts as though 100% of the mass of the golf club is concentrated in the club head itself. Moving the moment at the center of mass closer to the moment at the center of percussion adds desirable momentum to the club head of the golf club, providing the opportunity for the golfer to have greater accuracy and longer drives.

As discussed above, the present analysis is dictated by the fact that a golf club acts as a pendulum with the pendulum's pivot point located at a position just below the grip of a golfer; that is, a golf club obeys pendulum technology as the heavy club head swings on the shaft. A physical characteristic of a pendulum is that it does not have any reaction at the pivot point around which the pendulum swings.

Further to the preceding discussion, the pivot point is located according to a golfer's hand placement. In the conventional use of a golf club, the pivot point is located below the golfer's hands and above the end of the grip. The center of mass is defined to be that point of the golf club located below the pivot point and is generally located on the shaft spaced a short distance from the club head. The center of percussion, the ideal spot to strike a golf ball, is located on the club head dimensionally correct for the pendulum used for striking heavy blows.

The most important requirement of pendulum technology as applied to the present technique is that the mass of the club is minimized to achieve equality of moment of the club head with the total moment of the club itself (i.e., the grip, shaft and head). This is primarily achieved by reducing the weight of shaft and by reducing, or changing the weight of the grip.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 1 is an illustration of the principle dimensions and mass a golf club.

FIG. 3 is a flow chart depicting the method for designing a golf club.

DESCRIPTION OF THE PREFERRED EMBODIMENTS

Figure 2:
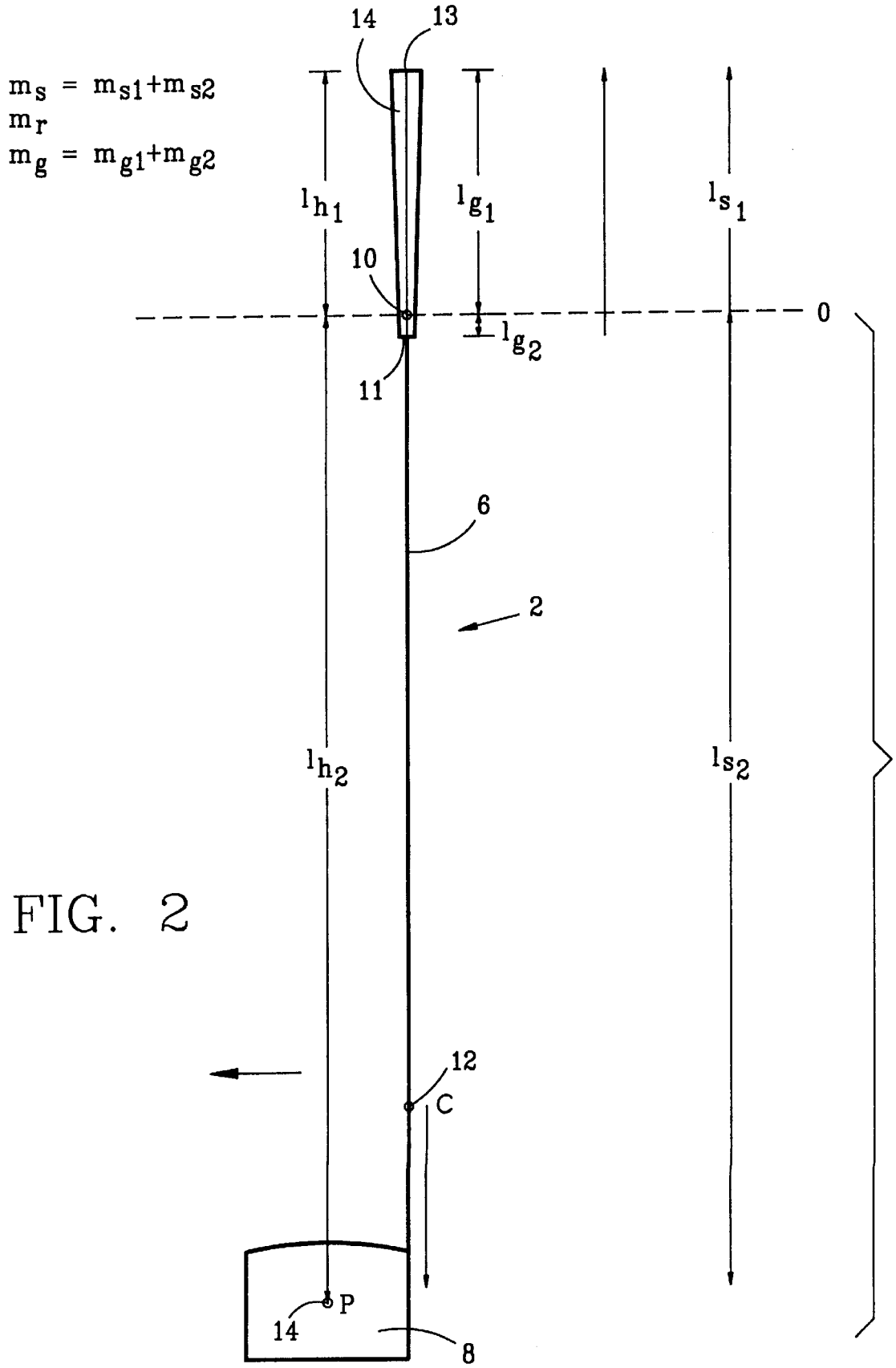
FIG. 2 is a further illustration of the principle dimensions of a golf club while applying pendulum technology in accordance with the present invention.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Referring to FIG. 1, the principle dimensions and mass distribution of a golf club 2 are illustrated. The golf club 2 is composed of three sections including the grip 4, the shaft 6, and the club head 8. The golf club 2, and a set of golf clubs (not shown), are within the standards of physical limits established by traditional golf club guidelines and the rules of golf.

The grip 4, shaft 6, and club head 8 are designed using materials common to the art of golf club making. The golf club 2 usually weighs between 10.0 and 13.5 ounces, or more. An example of a weight distribution of a 42" standard driver weighing 12.9 ounces is as follows: the grip 4 weighs 3.0 ounces, the shaft 6 weighs 1.4 ounces, and the club head 8 weighs 8.5 ounces.

In designing a golf club 2 in accordance with the present invention, it is first necessary to select a club length and determine which type of golf club wood or iron is to be designed. Next, a swing weight is selected and the pivot point location determined on the golf club. The center of mass and the center of percussion are also determined. In order to optimize the application of the present invention, a club head with a center of percussion located substantially at the center of the striking face should be used in constructing the golf club head.

With reference to FIG. 1, the center of mass for a golf club is defined as:

$$L=(A_G W_G+A_S W_S+A_P W_P)/W$$

where:

$A_G$=the distance from the butt end 13 of the club 2 to the center of mass for the grip $W_G$;

$A_S$=the distance from the butt end 13 of the club 2 to the center of mass for the shaft $W_S$;

$A_P$=the distance from the butt end 13 of the club 2 to the center of mass for the club head $W_P$;

$W_G$=the mass of the grip 4;

$W_S$=the mass of the shaft 6;

$W_P$=the mass of the club head 8;

L=the distance from the butt end 13 of the club 2 to the center of mass for the entire golf club 12; and W=the mass of the entire golf club 2.

As also discussed above, a swing weight for the golf club 2 must be selected. The swing weight preference depends upon the individual using the golf club 2, although it normally ranges from a C-5 to a D-5 classification. The parameters of the swing weight are well known in the golf industry and are measured by a number of available swing weight scales, and the like. The swing weight is generally defined by the equation:

$$W(L-12)=\text{Swing Weight}$$

Before beginning the mass analysis in accordance with the present invention, a few assumptions are made. With reference to FIG. 2, a golf club 2 acts as a pendulum. That being said the laws of pendulum technology govern the motion of the golf club 2 with the pendulum's pivot point 10 being approximately located at a position below the golfer's hands and above the grip end 11 of the grip 4. Those skilled in the art will, however, understand that the pivot point 10 may be varied depending upon specific swing preferences of the golfer and the specific use of the golf club 2.

Based upon the assumptions described above, and in accordance with the laws of statics and dynamics, the mass of the grip 4, the shaft 6, and the club head 8 are adjusted such that the moment at the center of mass 12 is substantially the same as the moment at the center of percussion 14. More specifically, by setting the moment of the center of mass 12 and the moment of the center of percussion 14 substantially equal around the pivot point 10, the mass of the shaft 6 is minimized and the mass of the grip 4 is minimized to move the moment of the center of mass 12 closer to the moment of the center of percussion 14 while maintaining the swing weight of the golf club 2 substantially the same.

Specifically, and as briefly discussed above, the highest degree of effectiveness in a golf club 2 is achieved when the moment at the center of mass 12 of the golf club 2 is essentially equal to the moment at the club head's center of percussion 14. When this occurs, the golf club 2 acts as though the total mass of the club 2 is concentrated in the club head 8. With reference to FIG. 2, this relation of moments is represented in the following equation:

$$l_c m_c=l_{h2} m_h$$

where:

$m_c$=the mass at the center of mass 12;

$l_c$=the length from the pivot point 10 to the center of mass 12;

$l_{h2}$=the length from the pivot point 10 to the center of percussion 14; and $m_h$=the mass of club head 8.

The following other components of the golf club 2 are also disclosed in FIG. 2 and are introduced so as to present a complete picture of the mass distribution of a golf club 2 in accordance with the present invention:

$l_c$=the length from pivot point 10 to the center of mass 12;

$l_{g1}$=the length from pivot point 10 to the butt end 13 of the club 2;

$l_{g2}$=the length from pivot point 10 to the grip end 11 (where $l_{g1}+l_{g2}$=the length of the grip 4);

$l_{s1}$=the length from pivot point 10 to the butt end 13 of the club 2;

$l_{s2}$=the length from pivot point 10 to the distal end of the shaft 6 (where $l_{s1}+l_{s2}$=the length of the shaft 6)

$l_{h1}$=the length from pivot point 10 to the butt end 13 of -=the club 2;

$l_{h2}$=the length from pivot point 10 to center of percussion 14 (where $l_{h1}+l_{h2}$=the length of the from the butt end 13 of the club 2 to the center of percussion 14".)

$m_{s1}$=the mass of shaft 6 from pivot point 10 to the butt end 13 of the shaft 6;

$m_{s2}$=the mass of shaft 6 from pivot point 10 to the distal end of the shaft 6 (where $m_{s1}+m_{s2}$=the mass of the shaft $m_s$);

$m_{g1}$=the mass of grip 4 from pivot point 10 to the butt end 13 of the shaft 6;

$m_{g2}$=the mass of grip 4 from pivot point 10 to the grip end 11 (where $m_{g1}+m_{g2}$=the mass of the grip mg); and $m_h$=the mass of the club head 8.

By respectively adjusting the mass of the grip 4, the shaft 6, and the club head 8, the ratio $l_{h2}m_h/l_cm_c$ can be made to equal approximately one (1), thereby making the moment of the center of mass substantially equal to the moment of the center of percussion. More specifically, by setting the moments substantially equal around the pivot point 10, mass $m_s$ and mass $m_g$ are decreased to move the center of mass 12 while maintaining the swing weight substantially the same. With this in mind, it may be desirable to increase the mass of the portion of the grip 4 above the pivot point 10 to maintain the golf club's swing weight within a desired and predetermined range.

Comparison with actual dimensions confirms the fact that golf clubs are designed as physical pendulums insofar as dimensions are concerned. By applying pendulum technology to improve the design of golf clubs in accordance with the present invention, the resulting golf club is designed as if the total mass of the golf club 2 is concentrated in the club head 8 substantially in line with the center of percussion 14.

The pivot point 10 is defined as the point around which the pendulum swings. On the golf club 2, the pivot point 10 is typically on the grip 4 and often about 1.5" from the bottom of the grip 4 or about 8.5" from the butt end 13 of the grip 4 according to the golfer's hands when the golf club 2 is gripped in a conventional manner.

Referring to FIG. 3, a flow chart for the method of designing a golf club, or set of golf clubs, in accordance with the present invention is illustrated. The first step is to select a club length. The club length is necessary to determine which type of golf club wood or iron is to be designed.

The second step is to select a swing weight and determine the center of mass for the golf club. Next, the pivot point of the golf club is defined.

Finally, the mass of the shaft, grip and club head are adjusted to bring the ratio $l_{h2}m_h/l_cm_c$ as close to one (1) as possible. More specifically, by setting the moments of the center of mass and the center of percussion substantially equal around the pivot point 10, mass $m_s$ and mass $m_g$ are decreased to move the center of mass 12 closer to the pivot point and thereby bring the moment at the center of mass substantially equal to the moment at the center of percussion 14.

After adjusting the mass within the golf club, the user has the choice to design another golf club or to end the procedure. This invention can be adapted for use on a computer or the like. A computer could aid in the calculations to allow for a faster and more efficient design.

The present invention has been described with reference to the moments about the center of mass and the center of percussion. As those skilled in the art are well aware, moments are directly mathematically related to momentum. With this in mind, the preceding calculations could readily be performed using the momentum about the center of mass and center of percussion as the basis for designing a golf club in accordance with the present invention. Such a variation would not alter the resulting golf club and would certainly be considered to fall within the spirit of the present invention.

While various preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A method of producing a conventional golf club including a grip with a grip end and a butt end, a shaft, and a club head having a center of percussion, wherein the golf club is considered to be a pendulum with a pivot point defined by a position slightly below the point at which hands of a golfer are positioned upon the grip when swinging the golf club, the method comprising the following steps:

(a) selecting a swing weight, wherein the swing weight is defined by the equation:

$$\text{swing weight}=W(L-12)$$

where:

L=a distance from the butt end of the club to a center of mass for the entire golf club.

W=the mass of the entire golf club.

(b) defining the pivot point according to hand placement of a golfer;

(c) defining a moment at the center of mass to be substantially equal to a moment at the center of percussion in accordance with the following equation:

$$l_cm_c=l_{h2}m_h$$

where:

$l_c$=length from the pivot point to the center of mass, $m_c$=mass at the center of mass, and $l_{h2}$=length from the pivot point to the center of percussion, and $m_h$=mass of head.

2. The method according to claim 1, wherein said center of mass on said club is defined by the following equation:

$$L=(A_GW_G+A_SW_S+A_PW_P)/W$$

where:

$A_G$=the distance from the butt end of the club to the center of mass for the grip.

$A_S$=the distance from the butt end of the club to the center of mass for the shaft.

$A_P$=the distance from the butt end of the club to the center of mass for the club head.

$W_G$=the mass of the grip.

$W_S$=the mass of the shaft.

$W_P$=the mass of the club head.

L=the distance from the butt end of the club to the center of mass for the entire golf club.

W=the mass of the entire golf club.

3. The method according to claim 2, wherein mass of the shaft and the mass of the grip are altered make the moment at the center of mass approximately equal the moment at the center of percussion.

4. The method according to claim 3, wherein total golf club weight ranges from 10 ounces to 13.5 ounces.

5. The method according to claim 4, wherein the swing weight ranges from a C-5 to a D-5 classification.

6. A method of producing a golf club including a grip, a shaft, a club head, a center of mass of the club and a center of percussion of the head, comprising the following steps:

(a) defining a desirable swing weight;

(b) respectively adjusting the mass of the grip and shaft to make the moment at the center of mass of the club substantially equal to the moment at the center of percussion of the head while maintaining the defined swing weight.

7. The method according to claim 6, wherein the overall mass of the golf club is adjusted by adjusting the mass of the grip.

8. The method according to claim 7, wherein the total golf club weight ranges from 10 ounces to 13.5 ounces.

9. The method according to claim 8, wherein said swing weight ranges from a C-5 to a D-5 classification.

* * * * *